United States Patent [19]

LaValley

[11] Patent Number: 4,632,739

[45] Date of Patent: Dec. 30, 1986

[54] ELECTROLYTIC CELL HEAD WITH REPLACEABLE INSERT AND METHOD OF PROTECTING THE SAME

[75] Inventor: Richard W. LaValley, Vancouver, Wash.

[73] Assignee: LaValley Industrial Plastics, Inc., Vancouver, Wash.

[21] Appl. No.: 756,741

[22] Filed: Jul. 19, 1985

[51] Int. Cl.[4] ..... C25B 1/26; C25B 9/00

[52] U.S. Cl. ..... 204/128; 204/256; 204/258; 204/266; 204/278; 204/279

[58] Field of Search ..... 204/242, 256, 258, 266, 204/278, 279, 128

[56] References Cited

U.S. PATENT DOCUMENTS 3,763,083 10/1973 Grotheer ..... 204/279 X 3,925,186 12/1975 Giacopelli ..... 204/256

4,332,648 6/1982 Spore ..... 204/270 X

*Primary Examiner*—Donald R. Valentine

*Attorney, Agent, or Firm*—Marger & Johnson

[57] ABSTRACT

A cell head for an electrolytic cell includes a generally tubular protective insert concentrically positioned within the head to shield the inner side walls thereof from the scouring action of corrosive gas bubbles produced during electrolysis within the cell. The insert includes a lower connecting flange which fits between the mating connecting flanges of the cell head and its underlying electrolyte tank to block off access of gas bubbles rising through the electrolytic within the tank to the inner side walls of the cell head. The insert is readily replaceable without replacing the entire cell head.

17 Claims, 2 Drawing Figures

ELECTROLYTIC CELL HEAD WITH REPLACEABLE INSERT AND METHOD OF PROTECTING THE SAME

BACKGROUND OF THE INVENTION

This invention relates generally to electrolytic cells and more particularly to the protection of the inner wall surface of the heads of such cells from corrosion.

Electrolytic reactions are utilized in industry to produce various gases, for example, chlorine and hydrogen. Such reactions are commonly carried out in a device known as an electrolytic cell. An understanding of the problems associated with the operation of such cells can best be grasped by referring to one such cell commonly used in industry, the chlorine electrolytic cell.

Chlorine electrolytic cells are used in the production of chlorine and hydrogen gases. These cells commonly comprise an upper, generally dome shaped head connected to an underlying brine tank.

In operation, an electrolyte comprising a brine solution of sodium chloride (NaCl) and water injected into the cell and retained in the brine tank and head is subjected to an electric current passed between a cathode and an anode. The current causes chloride ions to migrate to the anode where the chlorine gas ($Cl_2$) is formed. Hydrogen gas ($H_2$) and liquid sodium hydroxide (NaOH) are also formed. This particular electrolytic reaction is expressed as:

$$2NaCl+2H_2O \rightarrow H_2+Cl_2+2NaOH.$$

As the process proceeds, bubbles of chlorine and hydrogen gases rise through the liquid and collect in the upper portion of the cell head above the liquid surface. As the reaction continues, the level of brine in the cell drops. The reaction is carried out as a batch process, with the hydrogen and chlorine gases being taken off the top of the cell head and the sodium hydroxide remaining as a liquid in the brine tank.

Corrosion of electrolytic cells can be a problem depending on the reactivity of the reaction products with the material of which the cell is made. For example, the cell head of the chlorine cell is commonly made of fiberglass reinforced plastic (FRP), while the brine tank is commonly made of concrete. The fiberglass and chlorine gas in combination are reactive.

As chlorine production occurs in such a cell, a butter-like material approximately ⅛ inch thick coats the inside wall surfaces of the cell head. This "chlorine butter" is a reaction product formed by a chlorine contacting the FRP walls of the cell head. The butter coating is beneficial in that it protects the walls of the cell head from further reaction with the chlorine gas which would otherwise eventually destroy the walls from corrosion.

Chlorine bubbles rising through the liquid in the cell during electrolysis scour the cell head walls, removing the protective chlorine butter coating and enabling further reaction and corrosion. Thus, eventually the cell head corrodes to a point that it must be rebuilt or replaced to prevent it from developing cracks or holes which would allow the escape of deadly chlorine gas. Typically, this rebuilding or replacement must take place every one-and-one-half to two years. Both the rebuilding and replacement process are expensive and time consuming. There is, therefore, a need for improved means to protect cell heads against corrosion, thereby to increase their life and the safety of their use, and to reduce the frequency and cost of their replacement or repair.

The primary objective of the present invention is to inhibit the corrosion of electrolytic cell heads, thereby to increase their useful life and the safety of their use.

SUMMARY OF THE INVENTION

The present invention includes an easily replaceable cell head insert which prevents corrosion of the cell head inner wall surfaces by shielding such surfaces from corrosive gas bubbles rising through the electrolyte.

In a preferred embodiment, the replaceable insert comprises a generally tubular shield member positioned concentrically within the cell head inwardly of its side walls. Such member has a flanged lower end which is inserted between the mating surfaces of the electrolyte tank and the cell head to isolate the side walls of the head from rising bubbles of gas.

The present invention also comprises a method of prolonging the life of cell heads by protecting the inner side wall surfaces of such heads from the scouring action of corrosive gases rising into the head through the electrolyte.

The present invention further comprises an improved FRP cell head with a replaceable insert which shields the interior walls of the cell head housing from the corrosive scouring action of gaseous byproducts of electrolysis.

The foregoing and other objects, features, and advantages of the invention will become more readily apparent from the following detailed description, which proceeds with reference to the accompanying drawings.

DETAILED DESCRIPTION OF A PREFERRED EMBODIMENT

Figure 1:
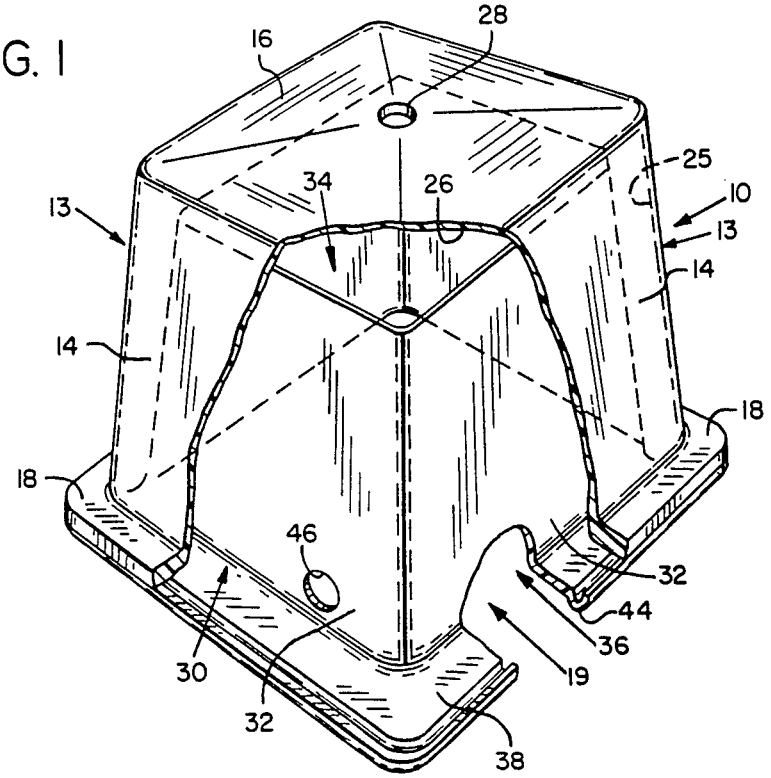
FIG. 1 is a partially cut-away perspective view of a cell head in accordance with the invention.
Figure 2:
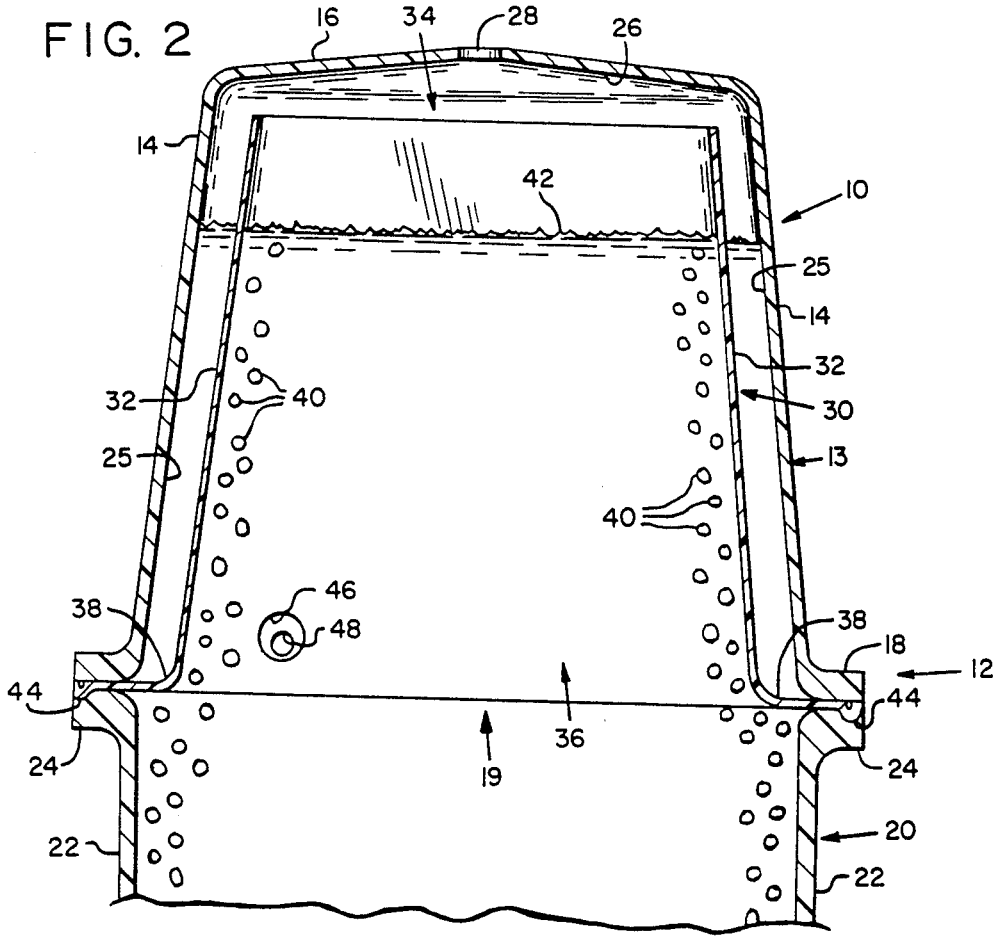
FIG. 2 is a vertical sectional view of the cell head of FIG. 1 connected to an underlying liquid-receiving tank of an electrolytic cell.

Referring to FIGS. 1 and 2, a cell head 10 and underlying electrolyte tank 20 together form an electrolytic cell 12. Cell head 10 is molded from FRP and is generally in the shape of a frustum of a pyramid. The cell head includes an outer housing 13 having four side walls 14 joined at their upper ends by a top wall 16 and terminating at their lower ends in an annular connecting flange 18 defining an open lower end 19. End 19 opens into the open top of tank 20. Tank 20 includes side walls 22 which contain electrolyte and which terminate in an upper end flange 24 for mating with cell head housing flange 18. Side walls 14 and top wall 16 include inner surfaces 25 and 26, respectively. At least the lower portion of side wall surfaces 25 are normally subjected to the scouring action of gas bubbles rising through the electrolyte along such surfaces, eventually causing the walls to corrode to an unsafe condition. A gas outlet opening 28 through the center of top wall 16 is normally connected to a conduit means (not shown) for the removal of gases formed by electrolysis.

The cell head also includes a removable, generally tubular sleeve-like insert member 30 sized and shaped to fit concentrically within the cell head housing, spaced inwardly of housing side walls 14. Insert 30 includes four side walls 32 defining, generally, a frustum of a pyramid. The walls 32 define a top opening 34 and a bottom opening 36, the latter concentric with bottom opening 19 of housing 13 and also opening into the top of tank 20.

Insert side walls 32 terminate in an annular lower end flange 38. With the insert installed within the cell head housing, insert flange 38 fits between housing flange 18 and tank flange 24 to effectively shield the inner side wall surface 25 from the scouring action of gas bubbles 40 rising through the electrolyte 42 in tank 20 and the cell head. Insert flange 38 includes a downwardly projecting bead 44 which nests in a mating groove in the top surface of tank flange 24. Housing flange 18 rests on top of insert flange 38. The three flanges are sealed using an appropriate liquid sealant, such as beeswax, and joined together under compression, using either fasteners or a strapping system (not shown), common in the art, thereby retaining the insert in position within the cell head housing. Thus, the insert defines a passage means whereby electrolyte and gases can pass freely between the tank and cell head, but without the gases contacting side walls 14.

Insert 30 and the cell head also include respective electrolyte intake ports 46, 48 through a lower portion of one side wall of each for receiving the outlet end of an electrolyte injection pipe (not shown) through which the tank and at least a lower portion of the cell head are filled with electrolyte. In FIG. 2, the upper surface of the electrolyte is indicated at 42.

Insert 30 and cell head housing 13 may be made of any suitable corrosion-resistant material, such as FRP. They need not be made of the same material.

OPERATION

In operation, electrolytic cell 12 is first charged with electrolyte through access openings 46, 48, providing an initial upper liquid level 42 within the cell. During electrolysis, gas bubbles form in the cell and rise through the liquid to surface 42, collecting above such surface in the uppermost portion of the cell head as the liquid level gradually drops. As the gases collect, they are drawn from the cell head through opening 28.

In a chlorine electrolytic cell where the insert and cell head housing are made of FRP, chlorine butter coats the exposed inner walls of the insert. Insert 30 directs rising bubbles of gaseous reaction products inwardly of housing side walls 14, whereby the bubbles do not contact side wall surfaces 25 as they rise through the cell head. In this fashion, insert 30 protects inner wall surfaces 25 of cell head housing 13 from the scouring action of the rising bubbles. For this purpose, the height of insert walls 32 should be greater than the upper level of electrolyte in the cell head.

When insert 30 corrodes to a point where it may no longer protect the inner wall surfaces of the cell head housing, the cell head is simply disconnected and removed from the tank, the worn insert removed from the cell head and replaced with a new one, and then the cell head assembly resealed and reconnected to the tank.

Having illustrated and described the principles of my invention by what is presently a preferred embodiment, it should be readily apparent to those skilled in the art that such embodiment may be modified in arrangement and detail without departing from such principles. I claim as my invention such embodiment and all such modifications and equivalents thereof as come within the spirit and scope of the following claims.

I claim:

1. A downwardly open electrolytic cell head for cooperation with an upwardly open electrolyte tank which opens into the cell head and contains an electrolyte solution, the cell head being adapted for collecting gaseous reaction products of electrolysis and being made of a material subject to corrosion by rising bubbles of gaseous reaction products, said cell head comprising:

a downwardly opening housing including side and top wall means and having an inner side wall surface normally exposed to the bubbles of gaseous reaction products;

a generally tubular member positioned within the cell head housing inwardly of the inner side wall surface for preventing exposure of said surface to said bubbles;

the tubular member defining passageway means enabling collection of gases within and removal of said gases from the housing;

mounting means for retaining the tubular member within the housing;

sealing means for sealing the lowermost portion of the inner side wall surface from said rising bubbles of gaseous reaction products; and the tubular member being removable from the housing for replacement without replacing the housing.

2. The apparatus according to claim 1 in which the tubular member extends vertically above the upper level of the electrolyte in the cell head.

3. The apparatus according to claim 1 in which the tubular member is a generally sleeve-like insert open at its upper and lower ends generally concentric to the inner side wall surfaces of the housing.

4. The apparatus according to claim 1 in which the lowermost portions of the housing and tubular member terminate in laterally extending overlapping flanges for retaining said tubular member within the housing and for preventing exposure of said inner side wall surface to said bubbles of gaseous reaction products.

5. The apparatus according to claim 1 in which aligned access openings are provided in the tubular member and housing for filling the electrolyte tank with an electrolyte solution.

6. The apparatus according to claim 1 in which the housing is made of fiberglass reinforced plastic.

7. The apparatus according to claim 1 in which the tubular member is made of fiberglass reinforced plastic.

8. The apparatus according to claim 1 in which the uppermost portion of the tank and the lowermost portion of the cell head each terminate in a laterally extending mounting flange for securing the cell head to the tank and wherein the sealing means and mounting means comprise a continuous annular flange at the lower portion of the tubular member for positioning between the cell head and tank flanges.

9. An insert for an electrolytic cell head for preventing corrosion of the cell head, the cell head including a downwardly opening housing terminating at its lower end in a laterally extending mounting flange, said insert comprising:

a generally tubular member for positioning within the cell head housing, said member including upwardly extending side walls defining a lower inlet opening and an upper outlet opening, the lower end portions of said side walls terminating in a laterally extending annular continuous lower wall portion for underlapping engagement with the mounting flange of the cell head housing, to thereby seal the lowermost portion of the cell head housing from rising bubbles of gaseous reaction products of electrolysis whereby said side walls and lower wall portion cooperate to guide said bubbles of gaseous reaction products into an upper portion of the housing while shielding the side walls of the housing from the scouring action of such bubbles.

10. The apparatus according to claim 9 in which the tubular member is made of fiberglass reinforced plastic.

11. An electrolytic cell comprising a lower liquid electrolyte tank;

an upper cell head overlying the tank and defining a gas collection chamber above a liquid electrolyte level;

said cell head including a downwardly opening housing defined by side and top walls and having inner side wall surfaces normally exposed to bubbles of gaseous reaction products within the electrolyte;

a generally tubular insert member positioned within said housing inwardly of said inner side wall surfaces;

said insert member defining passageway means through said housing enabling collection of gases within and removal of said gases from the housing;

means for removably retaining said insert member within said housing and interconnecting said housing, insert member and tank such that bubbles of gaseous reaction products rising from said tank through said electrolyte are blocked from contact with the side walls of said housing.

12. The apparatus according to claim 11 in which the upper terminus of the insert member within the housing is above the upper level of electrolyte within the housing.

13. The apparatus according to claim 11 in which the insert member is a generally sleeve-like member generally concentric with the side walls of the housing.

14. The apparatus according to claim 11 in which aligned access openings are provided in the tubular member and housing for charging the electrolyte cell with an electrolyte solution.

15. An electrolytic cell comprising:

a lower liquid electrolyte tank;

an upper cell head overlying the tank and defining a gas collection chamber above a liquid electrolyte level;

said cell head including a downwardly opening housing defined by side and top walls and having inner side wall surfaces normally exposed to bubbles of gaseous reaction products within the electrolyte;

a generally tubular insert member positioned within said housing inwardly of said inner side wall surfaces;

said insert member defining passageway means through said housing enabling collection of gases within and removal of said gases from the housing;

means for removably retaining said insert member within said housing and interconnecting said housing, insert member and tank such that bubbles of gaseous reaction products rising from said tank through said electrolyte are blocked from contact with the side walls of said housing; and the lowermost portions of the housing and tubular insert member terminating in laterally extending overlapping and abutting flanges, said flanges defining the means by which said tubular member is removably retained within the housing and said bubbles are blocked from access to the side walls of the housing.

16. A method of inhibiting corrosion of the inner side wall surfaces of an electrolytic cell head housing during the electrolytic process comprising:

directing bubbles of gaseous reaction products rising through the liquid electrolyte into the cell head housing inwardly of said inner side wall surfaces whereby said bubbles cannot contact and scour said side wall surfaces before rising to the liquid surface;

said directing of said bubbles comprising inserting a generally tubular shield into the cell head housing inwardly of said side wall surfaces and sealing the lower ends of said housing and shield from the passage of fluid therebetween, whereby the rising bubbles are forced inwardly of and out of contact with said inner side wall surfaces, thereby subjecting the shield to corrosion rather than the side walls and rendering the useful life of the housing substantially longer than the useful life of the shield; and periodically replacing the tubular shield without replacing the housing so as to prolong the useful life of the housing.

17. An electrolytic cell comprising:

a lower, upwardly open liquid electrolyte tank;

an upper, downwardly open cell head overlying the tank and defining a gas collection chamber above a liquid electrolyte level, the lower tank opening into the upper cell head;

said cell head including a downwardly opening housing defined by side and top walls and having inner side wall surfaces normally exposed to bubbles of gaseous reaction products within the electrolyte;

a generally tubular insert member positioned within said housing inwardly of said inner side wall surfaces;

said insert member defining passageway means through said housing enabling collection of gases within and removal of said gases from the housing;

mounting means for retaining the tubular member within the housing;

sealing means for sealing the lowermost portion of the side wall surfaces from said rising bubbles of gaseous reaction products; and the tubular member being removable from the housing for replacement without replacing the housing.

* * * * *